US011867051B2

(12) United States Patent
Moody

(10) Patent No.: US 11,867,051 B2
(45) Date of Patent: Jan. 9, 2024

(54) INCREMENTAL DOWNHOLE DEPTH METHODS AND SYSTEMS

(71) Applicant: Brian Moody, Hannover (DE)

(72) Inventor: Brian Moody, Hannover (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/179,672

(22) Filed: Feb. 19, 2021

(65) Prior Publication Data

US 2021/0262340 A1 Aug. 26, 2021

Related U.S. Application Data

(60) Provisional application No. 62/979,091, filed on Feb. 20, 2020.

(51) Int. Cl.

| | |
|---|---|
| ***E21B 47/04*** | (2012.01) |
| ***E21B 47/16*** | (2006.01) |
| ***E21B 47/26*** | (2012.01) |
| ***E21B 47/18*** | (2012.01) |

(Continued)

(52) U.S. Cl.

CPC ..... *E21B 47/04* (2013.01); *E21B 47/09* (2013.01); *E21B 47/13* (2020.05); *E21B 47/16* (2013.01); *E21B 47/18* (2013.01); *E21B 47/26* (2020.05)

(58) Field of Classification Search

CPC ..... E21B 47/04; E21B 47/13; E21B 47/26; E21B 47/09; E21B 47/16; E21B 47/18

See application file for complete search history.

(56) References Cited

U.S. PATENT DOCUMENTS

| | | | | |
|---|---|---|---|---|
| 5,581,024 | A | 12/1996 | Meyer, Jr. et al. | |
| 5,812,068 | A * | 9/1998 | Wisler | E21B 47/26 175/45 |
| 9,004,195 | B2 | 4/2015 | Regener et al. | |

(Continued)

FOREIGN PATENT DOCUMENTS

| | | | |
|---|---|---|---|
| WO | 9321545 | A1 | 10/1993 |
| WO | 02086287 | A2 | 10/2002 |
| WO | 2016100693 | A1 | 6/2016 |

OTHER PUBLICATIONS

International Search Report, International Application No. PCT/US2021/018729, dated May 24, 2021, Korean Intellectual Property Office; International Search Report 4 pages.

(Continued)

*Primary Examiner* — Amine Benlagsir

(74) *Attorney, Agent, or Firm* — CANTOR COLBURN LLP

(57) ABSTRACT

Disclosed herein are methods for performing downhole operations. The methods include determining, at the earth surface, a first depth value of a downhole component in a borehole, transmitting to the downhole component in the borehole a first signal indicating the first depth value, changing a depth of the downhole component in the borehole, determining, at the earth surface, a second depth value of the downhole component in the borehole, transmitting, to the downhole component in the borehole, a second signal indicating the second depth value, and updating a downhole operation performed by the downhole component based on at least one of the first depth value and the second depth value.

20 Claims, 3 Drawing Sheets

(51) Int. Cl.
*E21B 47/13* (2012.01)
*E21B 47/09* (2012.01)

(56) References Cited

U.S. PATENT DOCUMENTS

| | | | | |
|---|---|---|---|---|
| 2003/0010495 | A1 | 1/2003 | Mendez et al. | |
| 2006/0180349 | A1 | 8/2006 | Dshevskiy | |
| 2008/0165026 | A1 | 7/2008 | Downton | |
| 2010/0286916 | A1* | 11/2010 | Wang | G01V 3/20 702/9 |
| 2014/0278111 | A1* | 9/2014 | Gerrie | E21B 47/002 702/8 |
| 2015/0226050 | A1* | 8/2015 | Bartel | E21B 45/00 700/275 |
| 2016/0312600 | A1 | 10/2016 | Wu et al. | |
| 2016/0327680 | A1* | 11/2016 | Jain | G01V 5/101 |
| 2017/0138181 | A1 | 5/2017 | Ross et al. | |
| 2019/0100985 | A1* | 4/2019 | Papouras | E21B 44/00 |
| 2019/0187316 | A1* | 6/2019 | Mathiszik | E21B 47/095 |
| 2020/0325741 | A1* | 10/2020 | Hutchinson | E21B 47/04 |

OTHER PUBLICATIONS

International Written Opinion, International Application No. PCT/US2021/018729, dated May 24, 2021, Korean Intellectual Property Office; International Written Opinion 6 pages.

Smit et al., "Residual Stress Measurement in Compostie Laminates Using Incremental Hole-Drilling with Power Series"; Experimental Mechanics; Jun. 4, 2018; 15 pages.

* cited by examiner

INCREMENTAL DOWNHOLE DEPTH METHODS AND SYSTEMS

CROSS REFERENCE TO RELATED APPLICATIONS

This application claims the benefit of an earlier filing date from U.S. Provisional Application Ser. No. 62/979,091, filed Feb. 20, 2020, the entire disclosure of which is incorporated herein by reference.

BACKGROUND

1. Field of the Invention

The present invention generally relates to subsurface operations and more particularly to depth measurements and incremental depth measurements to be obtained during subsurface operations.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to energy or a material (e.g., heat, a gas, or fluid) contained in a formation located below the earth's surface. Different types of tools and instruments may be disposed in the boreholes to perform various tasks and measurements.

During drilling operations, many of these boreholes need to have a precise location and geometry in order to increase efficiency for its desired purpose. The geometry generally includes, for example, depth or drilled distance, inclination, build-up rate, and azimuth. The location may relate to a distance to a geologic formation boundary and/or a distance to an adjacent borehole.

Knowledge of depth may enable precise drilling trajectory and enables positioning of components at specific locations along a drilled borehole. For example, sampling and testing may be required at specific locations or intervals, and thus accurate depth data is important for such operations. Hence, development of drilling control systems to increase the accuracy and precision of drilling boreholes would be well received in the drilling industry.

SUMMARY

In accordance with some embodiments, disclosed herein are systems and methods for performing a while-drilling operation. The methods include determining an initial surface-depth, at the surface, of a downhole component and generating an initial surface-depth measurement, transmitting the initial surface-depth measurement to the downhole component, increasing a depth of the downhole component, determining an incremental depth and generating an incremental depth measurement, transmitting the incremental depth measurement to the downhole component, and updating a downhole operation performed by the downhole component based on at least one of the initial surface-depth measurement and the incremental depth measurement.

In accordance with some embodiments, disclosed herein are systems and methods for collecting downhole data during a drilling operation. The methods include transmitting a surface-depth value from the surface to a downhole component, collecting a first downhole data element using at least one sensor located on the downhole, and assigning the surface-depth value to the first downhole data element.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
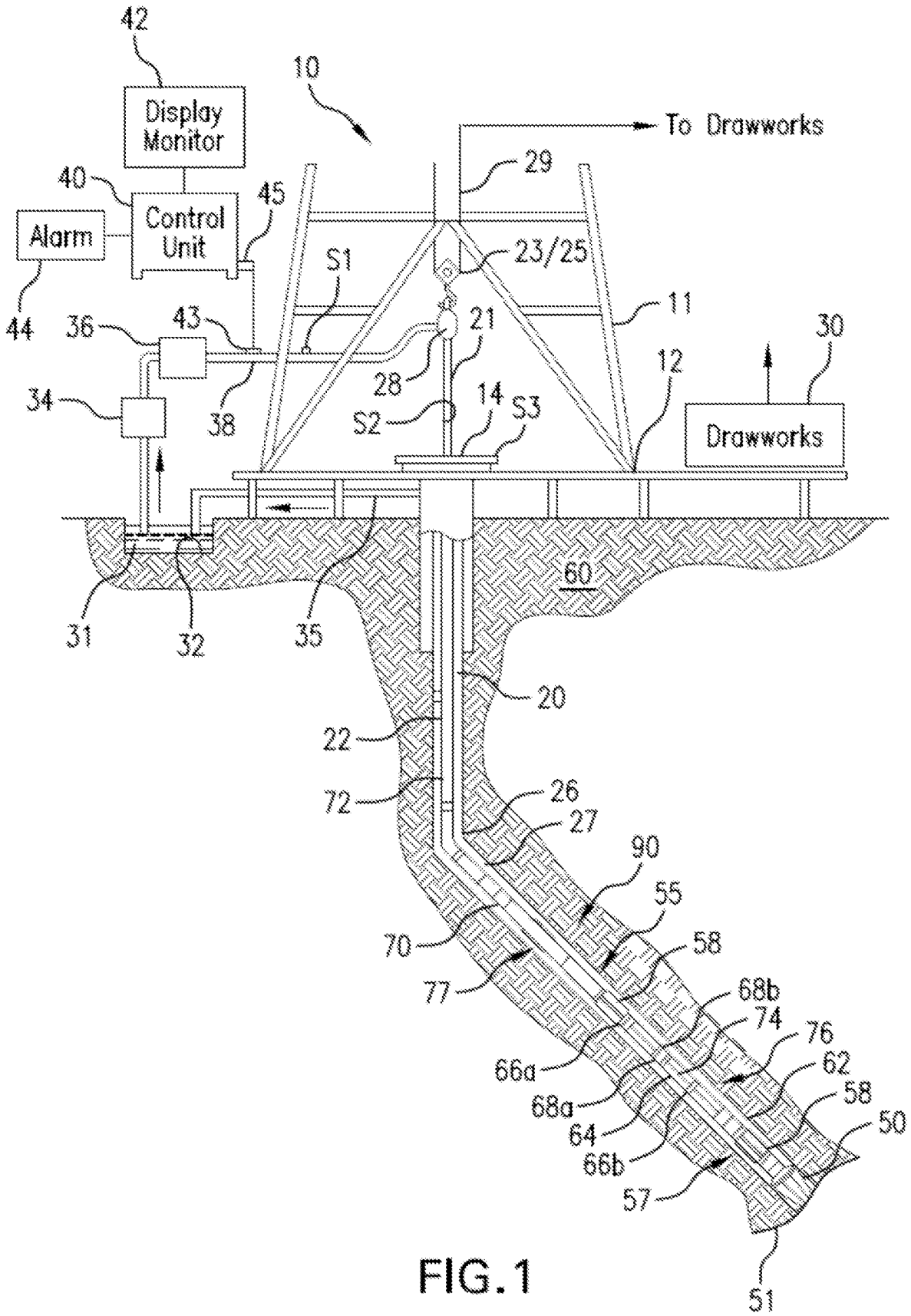
FIG. 1 is an example of a system for performing subsurface operations that can employ embodiments of the present disclosure.

FIG. 1 shows a schematic diagram of a system for performing subsurface operations (e.g., downhole, within the earth or below other surface and into a formation). As shown, the system is a drilling system 10 that includes a downhole string, such as a drill string 20 having a drilling assembly 90, also referred to as a bottomhole assembly (BHA), conveyed in a wellbore or borehole 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegration device 50, such as a drill bit attached to the end of the drilling assembly 90, breaks, destroys, or disintegrates the geological formations when it is rotated to drill the borehole 26. The drill string 20 is coupled to a drawworks 30 via a kelly joint 21, swivel 28, traveling block 25, and line 29 through a pulley 23. During the drilling operations, the drawworks 30 is operated to control the weight-on-bit (WOB), which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the inner bore of the drill string 20 via a desurger 36, fluid line 38 and the kelly joint 21. Fluid line 38 may also be referred to as a mud supply line. The drilling fluid 31 is discharged at the borehole bottom 51 through an opening in the disintegration device 50. The drilling fluid 31 circulates uphole through the annular space 27 between the drill string 20 and the borehole 26 and returns to the mud pit 32 via a return line 35. A sensor S1 in the fluid line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the borehole 26. The system may further include one or more downhole sensors 70 located on the drill string 20 and/or the drilling assembly 90.

In some applications the disintegration device 50 is rotated by rotating the drilling tubular 22. However, in other applications, a drilling motor 55 (such as a mud motor) disposed in the drilling assembly 90 is used to rotate the disintegration device 50 and/or to superimpose or supplement the rotation of the drill string 20 (rotary mode). In either case, the rate of penetration (ROP) of the disintegration device 50 into the earth formation 60 for a given formation and a drilling assembly largely depends upon the weight-on-bit and the rotational speed of the disintegration device 50. In one aspect of the embodiment of FIG. 1, the drilling motor 55 is coupled to the disintegration device 50 via a drive shaft (not shown) disposed in a bearing assembly 57. If a mud motor is employed as the drilling motor 55, the mud motor rotates the disintegration device 50 when the drilling fluid 31 passes through the drilling motor 55 under pressure. The bearing assembly 57 supports the radial and axial forces of the disintegration device 50, the downthrust of the drilling motor and the reactive upward loading from the applied weight-on-bit. Stabilizers 58 coupled to the bearing assembly 57 and at other suitable locations on the drill string 20 act as centralizers, for example for the lowermost portion of the drilling motor assembly and other such suitable locations. The drilling motor 55 may include an Adjustable Kick Off sub (AKO). The deployment of an AKO provides the build of inclination of the borehole when drilling in a sliding mode (i.e., no drill string rotation and the disintegration device is only drive by the rotor of the drilling motor). Alternatively, a deviated borehole may be drilled by using a deflection device, such as a steering unit or device (not shown), that enables an operator to steer the disintegration device (e.g., drill bit) in a desired direction. A steering unit comprises one or more force application devices that may be actuated and controlled hydraulically, electrically, or both.

A surface control unit 40 receives signals from the downhole sensors 70 and devices via a sensor 43 (e.g., a pressure sensor) placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40. For example, a surface depth tracking system may be used that utilizes the block height measurement (traveling block 25) to determine a length of the borehole (also referred to as measured depth of the borehole) or the distance along the borehole from a reference point at the surface to a predefined location on the drill string 20, such as the disintegration device 50 or any other suitable location on the drill string 20 (also referred to as measured depth of that location, e.g. measured depth of the disintegration device 50). Determination of measured depth at a specific time may be accomplished by adding the measured block height to the sum of the lengths of all equipment that is already within the wellbore at the time of the block-height measurement, such as, but not limited to drilling tubulars 22, drilling assembly 90, and disintegration device 50. Depth correction algorithms may be applied to the measured depth to achieve more accurate depth information. Depth correction algorithms, for example, may account for length variations due to pipe stretch or compression due to temperature, weight-on-bit, wellbore curvature and direction. By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The term measured depth (MD) refers to the length of a downhole string in the borehole, wherein in the borehole refers to a location below the rotary table 14. The measured depth diverts from a true vertical depth (TVD) when the borehole is not oriented completely vertically or parallel to the direction of the gravitational force. For example, a horizontal borehole (i.e., inclination of 90°) does not increase in TVD when progressing drilling in the horizontal direction, but the measured depth MD increases. When generally referring to "depth" herein, the depth referred to is measured depth (MD).

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as tape unit, memory unit, etc. for recording data and other peripherals. The surface control unit 40 also may include simulation models for use by the computer to process data according to programmed instructions. The control unit responds to user commands entered through a suitable device, such as a keyboard. The surface control unit 40 can output certain information through an output device, such as s display, a printer, an acoustic output, etc., as will be appreciated by those of skill in the art. The surface control unit 40 is adapted to activate alarms 44 when certain unsafe or undesirable operating conditions occur.

The drilling assembly 90 may also contain other sensors and devices or tools for providing a variety of measurements relating to the earth formation 60 surrounding the borehole 26 and for drilling the borehole 26 along a desired path. Such devices may include a device for measuring formation properties, such as the formation resistivity or the formation gamma ray intensity around the borehole 26, near and/or in front of the disintegration device 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be done above a lower kick-off subassembly 62 for estimating or determining the resistivity of the earth formation 60 around the drill string 20 including the drilling assembly 90. Another location may be near or in front of the disintegration device 50, or at other suitable locations. A directional survey tool 74 that may comprise means to determine the direction of the drilling assembly 90 with respect to a reference direction (e.g., magnetic north, vertical up or down direction, gravitational force direction etc.), such as a magnetometer, gravimeter/accelerometer, gyroscope, etc. may be suitably placed for determining the direction of the drilling assembly, such as the inclination, the azimuth, and/or the toolface of the drilling assembly. Any suitable direction survey tool may be utilized. For example, the directional survey tool 74 may utilize a gravimeter (accelerometer), a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a wellbore trajectory in a three-dimensional space. In the above-described example configuration, the drilling motor 55 transfers power to the disintegration device 50 via a shaft (not shown), such as a hollow shaft, that also enables the drilling fluid 31 to pass from the drilling motor 55 to the disintegration device 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, etc. may be placed at suitable locations in the drilling assembly 90 for providing information useful for evaluating the earth formation 60 (i.e., subsurface formation) or fluids along borehole 26. Such devices may include, but are not limited to, acoustic tools, nuclear tools, nuclear magnetic resonance tools, permittivity tools, and formation testing and sampling tools.

The above-noted devices may store data to a memory downhole and/or transmit data to a downhole telemetry system 72 (downlink), which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system (including a mud pulser) may be used to communicate data between the downhole sensors 70 and devices and the surface equipment during drilling operations. A sensor 43 placed in the fluid line 38 may detect the mud pressure variations, such as mud pulses responsive to the data transmitted by the downhole telemetry system 72. Sensor 43 may generate signals (e.g., electrical signals) in response to the mud pressure variations and may transmit such signals via a conductor 45 or wirelessly to the surface control unit 40. In other aspects, any other suitable telemetry system may be used for one-way or two-way data communication between the surface and the drilling assembly 90, including but not limited to, a wireless telemetry system, such as an acoustic telemetry system, an electro-magnetic telemetry system, a wired pipe, or any combination thereof. The data communication system may utilize repeaters in the drill string or the wellbore. One or more wired pipes may be made up by joining drill pipe sections, wherein each pipe section includes a data communication link that runs along the pipe. The data connection between the pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight-on-bit is controlled from the surface, typically by controlling the operation of the drawworks. However, a large number of the current drilling systems, especially for drilling highly deviated and horizontal wellbores, utilize coiled-tubing for conveying the drilling assembly subsurface. In such application a thruster is sometimes deployed in the drill string to provide the desired force on the disintegration device 50. Also, when coiled-tubing is utilized, the tubing is not rotated by a rotary table but instead it is injected into the wellbore by a suitable injector while a downhole motor, such as drilling motor 55, rotates the disintegration device 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegration device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting a liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

The one or more sensors may be located in a drilling dynamics tool, preferably located close to the bit, but may be located at any position in or along the BHA. The drilling dynamic tool is designed to sample drilling dynamics data at a high timely resolution (e.g., 1000 Hz and faster). The BHA may comprise more than one drilling dynamics tool allowing for observation and/or monitoring of drilling dynamics data at different locations in or along the BHA. Such drilling dynamics data may include, without limitation, acceleration (lateral, axial, tangential), bending moment (torque), temperature, pressure, variation in earth magnetic field, weight on bit, and revolutions per minute. In some embodiments described herein, the sensors used to sample drilling dynamics may be stand-alone sensors located somewhere on or in the BHA, independent of a drilling dynamics tool.

Although FIG. 1 is shown and described with respect to a drilling operation, those of skill in the art will appreciate that similar configurations, albeit with different components, can be used for performing different subsurface operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired subsurface operation(s), such as a completions operation, a fracturing application, a re-entry application, or a pumping application.

In current systems, as noted above, during drilling operations, it may be difficult to accurately determine and/or estimate depth downhole (i.e., depth or distance from surface to a drill bit, BHA, or other component). However, knowing or accurately estimating depth may be important to ensure efficient drilling operations, activation of specific operations, direction drilling control, and/or to prevent damage to downhole components. Advantageously, embodiments provided herein are directed to systems and methods for providing accurate depth information to a downhole component, also referred to as downhole depth. In accordance with some embodiments, a preliminary depth is measured, known, or obtained, and subsequently, regular increase interval depths, as measured at the surface, may be transmitted downhole such that downhole data may be correlated to the depth and/or certain operations may be performed downhole, based on the depth information received downhole.

Embodiments described herein are directed to ensuring depth measurements/data is available downhole. For example, in accordance with embodiments of the present disclosure, depth information is transmitted downhole to a BHA or other component, and the BHA or other component can then use the depth information to correlate data or perform an action/operation. In some configurations, data collected downhole can be synchronized to depth as based on the transmitted depth information, thus enabling downhole processing/calculations by a downhole processing system and/or enabling post-run data analysis by a surface processing system that is synchronized to depth measured on surface. That is, in accordance with embodiments of the present disclosure, a measured depth is transmitted downhole to provide accurate depth data/information to be incorporated into data and/or operations performed downhole (e.g., at or in a BHA). The terms depth information, surface-depth, measured depth, depth, or measured absolute depth in this disclosure refer to a depth value that is determined at the earth surface, using a surface distance decoder, such as a drawworks decoder or a laser based distance measurement determining the position of the traveling block. The measured depth is the distance between a surface location and a location along the downhole string. The measured depth is the length of the downhole string below the rotary table 14.

In accordance with embodiments of the present disclosure, regular or irregular increments of changes in depth are transmitted downhole through simple downlinks or changes in mud system pressure (e.g., 5 sec fluid bypass for pressure change) to create a step change in tool depth logged in downhole memory and stored in a table for post-run comparison. The transmission of the increments may be performed automatically by the surface control unit 40. In some configurations, initial depth can be transmitted and then incremental depths (incremental measured depth) may be transmitted every 1 foot, 5 feet, 10 feet, or any user-defined incremental depth interval (of any measurement unit).

As used herein, the terms incremental depth information, incremental measured depth, incremental surface-depth, or incremental depth refer to an incremental depth value that is determined at the earth surface using the same means as the measuring of the measured absolute depth. The initial depth may be the bit depth. The bit depth equals the borehole depth when the bit is on-bottom. Knowing the bit depth, any sensor depth of the BHA located above the bit can be calculated using the senor offset. Alternatively, knowing the depth of a sensor, the bit depth or the depth of another sensor can be calculated using the sensor offset.

A simple downlink may be a coded telemetry signal, such as, for example and without limitation, a flow rate variation, a rotary speed change of the rotational speed of the drill string, or a pump cycle. A simple downlink does not transmit an actual measured depth value or an incremental measured depth value, but is an indication of a specific measured depth value is reached or a specific incremental depth value is reached when moving the downhole string in the borehole while drilling, tripping, or any other downhole operation. For example, a ping signal may be transmitted each time an incremental depth value is reached. The ping signal may be only one flow rate change or one rotary speed change or one flow cycle (e.g., one bit or one bit predefined code). In an alternative embodiment, the ping signal may comprise multiple flow rate variations, rotary speed changes or flow cycles, forming a ping code (two-bit ping, three-bit ping, or multiple-bit ping (e.g., multiple-bit predefined code)). There may be different predefined ping codes for different incremental measured depth values. For example, when the downhole string (e.g., the drilling bit or disintegrating device) progresses an incremental depth value of 1 foot, the depth increment may be indicated by a first ping code, an incremental depth value of 5 feet may be indicated by a second ping code and so on. The downhole processing system may be programmed to know the incremental depth value (e.g., predetermined depth increment). A ping signal or ping code may be transmitted from the earth surface to the downhole telemetry system or downhole component indicating the incremental depth is reached. The incremental depth value may be a positive value (e.g., drilling, tripping-in) or may be a negative value (e.g., tripping out). In another embodiment, the actual incremental measured depth value may be transmitted encoded in a telemetry signal and may be received and decoded downhole by a telemetry system (e.g., telemetry system 72) to retrieve the incremental measured depth value from the transmitted telemetry signal. In this case, the transmitted code comprises the incremental measured depth value and does not only indicate that an incremental measured depth value is reached while progressing in the borehole.

In practice, transmitting the actual incremental measured depth value takes bandwidth and time. Using a ping signal or ping code instead provides for a faster and more reliable/efficient way to transmit the incremental measured depth from the earth surface to downhole. In one embodiment, the actual initial measured depth value may be transmitted encoded in a telemetry signal and may be received and decoded downhole by the telemetry system to retrieve the initial measured depth value. In another embodiment, the initial measured depth may also be indicated by a ping signal or a ping code when the downhole string (e.g., the drill bit or disintegrating device) reaches the initial measured depth. The downhole processing system may be programmed to know the initial measured depth value (e.g., predetermined initial measured depth). A ping signal or ping code may be transmitted from the earth surface to the downhole telemetry system or downhole component indicating the initial measured depth is reached.

In accordance with some embodiments, the transmission of a calibration depth value may increase the accuracy of the depth information used by the downhole processing system. The calibration depth value may be transmitted after a predefined depth interval is reached by the moving downhole string. For example, every 30 m (about 100 feet) of drilling, a calibration depth value may be transmitted from the earth surface to the downhole telemetry system. When receiving the calibration depth value downhole, the downhole processing system is configured to calibrate the depth information used in the downhole processing. If for some reason the information on reaching an incremental measured depth value may not have been registered downhole (e.g., missing a ping signal due to bad decoding), then the calibration depth value can be used to calibrate or correct the depth information used downhole. The calibration depth value may be transmitted coded in a telemetry signal and may be received and decoded downhole by the telemetry system, or may be transmitted by using a ping signal after reaching a predefined calibration depth with the downhole string (e.g., the drill bit).

Referring again to FIG. 1, a drilling operation may be performed using the disintegration device 50 which is disposed on the end of the drill string 20. In some drilling system configurations, as the borehole 26 is drilled or otherwise formed, additional drilling tubulars 22 are added to the drill string 20. The depth of the borehole 26 increases and thus the position of one or more components (e.g., drilling assembly 90, downhole sensors 70, etc.) will increase in depth (or distance) from the earth surface along the borehole 20.

Various downhole tools and components may require information related to depth, whether to perform a specific operation or to ensure that data collected downhole is accurately synchronized with depth data.

For example, automated drilling may take advantage of accurate depth information, including but not limited to operations based on a planned trajectory. In some embodiments, a well path may be programmed into a BHA. The well path may include coordinates, depth (MD or TVD), and planned trajectory. Based on this information, i.e., when certain criteria is met, the BHA may adjust a trajectory to drill in a different direction. To ensure a desired well trajectory is achieved, the BHA may receive depth information from the earth surface and calculate settings based therein. The settings may include steering operations to ensure that the drilling borehole is within defined parameters or adjustment of operational parameters, such as weight-on-bit (WOB), flow rate, or rotary speed of the drill string (surface RPM or motor RPM).

Another application that may take advantage of embodiments described herein is petrophysical operations. In such application, downhole sensors or other data collection and measurements may be aligned with the measured depth as transmitted from the earth surface. Calculations may be performed on a combined dataset of petrophysical measurement (e.g., density, porosity, permeability, conductivity, reservoir fluid type, etc.) and depth position, thus enabling higher resolution than typically achieved.

Downhole imaging applications may also benefit from embodiments of the present disclosure. In such applications, images obtained downhole may be segmented according to depth or depth-interval and enable compression of such imagine. Alignment of multiple images may be achieved to improve compression ratios or enable combined image types. Furthermore, downhole operations and computing may be achieved based on image data and downhole depth. For example, downhole analysis and interpretation may be employed using algorithms for automated downhole image interpretation and/or analysis (e.g., formation dip, structure, fracture, etc.). Based on the downhole image interpretation, geosteering decisions may be made automatically by the downhole processing system to place the borehole inside a hydrocarbon reservoir. The geosteering may use an earth model and/or offset data from an earlier borehole.

Furthermore, for example, data transmission may be based, in part, upon higher resolution depth or depth-interval data. Data collected downhole may be requested, from the surface, over a specific depth-interval in high resolution, and across all measurement. For example, due to the high resolution, data captured with pumps being inoperable and a battery active may be obtained. Further, given the improved resolution (potentially short depth-interval), if there is poor decoding and/or a relatively high noise-to-signal ratio, such issues may be less impactful on total data analysis.

Figure 2:
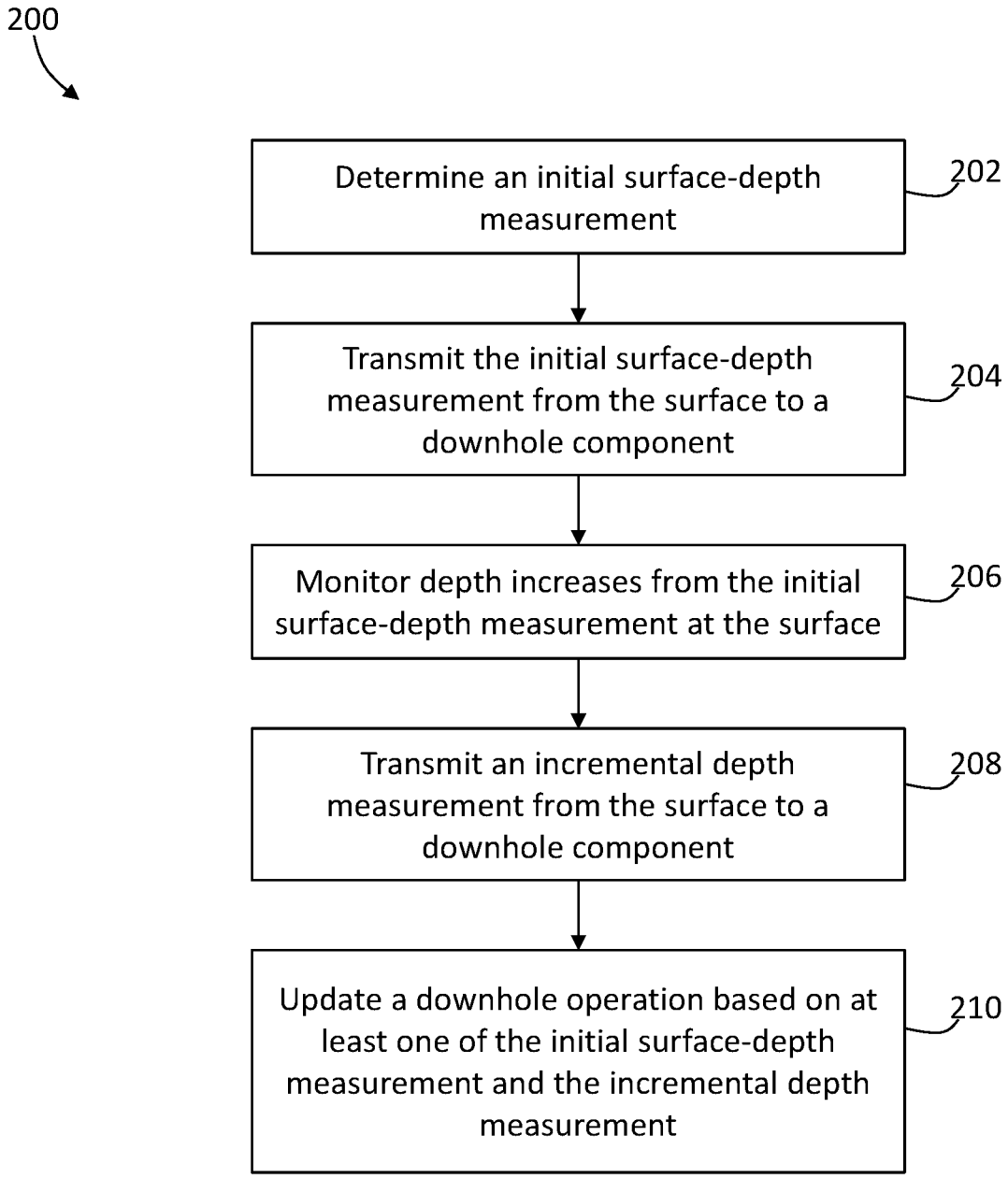
FIG. 2 is a flow process for performing a downhole operation in accordance with an embodiment of the present disclosure.

Turning now to FIG. 2, a schematic flow process 200 in accordance with an embodiment of the present disclosure is shown. The flow process 200 may be performed using a system similar to that shown and described with respect to FIG. 1, or with other drilling systems as known in the art.

At block 202, an initial surface-depth measurement is determined. The initial surface-depth measurement is a depth measurement performed at the earth surface from the surface to a downhole location, such as drill bit location (bit depth), BHA location, etc. In one embodiment, the initial surface-depth measurement may be a depth-to-bit from the surface. Even with other components not located at the bit, the distance from such component to-bit (sensor offset) is known, and thus the depth of a given component may be determined from a single initial surface-depth measurement. The initial surface-depth measurement may be based on a length of drill string and components disposed within a borehole. Such measurement may be known as a driller's depth. Various other mechanisms and/or processes for measuring an initial surface-depth measurement may be employed without departing from the scope of the present disclosure, as known in the art. For example, in some embodiments, a drawworks with a wire wrap may be configured with a depth encoder that is used to measure the depth of one or more components of the downhole system.

At block 204, the initial surface-depth measurement is transmitted from the surface to a downhole component, such as a BHA, steering unit, telemetry system, measurement unit, etc. The initial surface-depth measurement may be a piece of data that is recorded within a downhole receiving unit (e.g., part of a BHA, steering unit, measurement unit, etc.). In some embodiments, the downhole receiving unit may be a discrete unit or system configured for information/data transmission and receipt, e.g., for communication with the surface. The transmission from surface to downhole of the initial surface-depth measurement may be by mud pulse telemetry, downlink, RFID tag sent downhole, rotary speed changes, pump cycling, wired pipe telemetry, electromagnetic transmission, seismic gun firing, vibration along the string, etc.

At block 206, at the surface, increases in depth from the initial surface-depth measurement are monitored. In some embodiments, the increases in depth may be monitored and/or measured using the same method as used in block 202 for measuring the initial surface-depth measurement. In other embodiments, the increases in depth may be monitored and/or measured using a different method or process than that used in block 202. The increases in depth may be represented in incremental depth measurements or incremental depth data (e.g., incremental measured depth (incremental MD)). The incremental depth measurements may be based on a desired increment, such as 1 foot, 5 feet, 10 feet, 30 feet, 100 feet, etc. or any other user-defined increment or interval (in any desired units).

At block 208, the incremental depth measurement is transmitted downhole to the downhole component. The transmission may be made in the same way that the initial surface-depth measurement is transmitted downhole. The transmission of the incremental depth measurements may be made at a specific interval, which may be associated with the interval at which the incremental depth measurements are made. The transmissions of the incremental depth measurements may be received at the same component that received the initial surface-depth measurement.

At block 210, the downhole component may update a downhole operation based on at least one of the initial surface-depth and/or the incremental depth measurement. For example, the downhole component may receive the initial surface-depth measurement and record such data. The recorded data may be updated based upon receipt of the incremental depth measurements. As such, in some embodiments, the downhole component may record a depth at which data is collected/obtained by the downhole component (or other downhole components). In other embodiments, in alternatively or in combination therewith, a downhole component may perform a specific action based on a specific depth being reached. For example, a steering unit may adjust a direction of wellbore trajectory, automatically and without steering parameters transmitted from the earth surface, based on a specific depth. In some embodiments, a downhole data collection may be performed (e.g., sampling, imaging, etc.). The downhole data may include or be updated with downhole depth information based on the initial surface-depth and/or the incremental depth measurement. The depth-modified downhole data may be stored downhole in a memory or may be transmitted to the surface. In some embodiments, the depth information may be stored downhole with collected downhole data. Having the depth, at which the collected downhole data were acquired, assigned to the downhole data allows for joined downhole data processing of downhole data from different downhole sensors. Accordingly, automated geosteering may be enabled without interference from the earth surface. Furthermore, downhole log creation becomes possible. After retrieval of a component (e.g., tripping), the downhole data may be depth correlated and synchronized to enable accurate depth-correlation and data analysis.

In one non-limiting example, a system may be configured with a surface control unit that utilizes surface software designed for logging-while-drilling, wireline, or surface logging services. In this embodiment, every time there is a change of depth at a specified depth interval (e.g., 1, 5, 100, etc. in feet, meters, or other distance unit), the system triggers an automatic downlink from a surface control unit to a downhole components (e.g., downhole equipment) to provide depth data and enable the tools 'know' that the specific increment has been made. The depth data may be logged in memory of the downhole component(s) for sensor spacing and aligning each measurement on depth downhole, for downhole-processing or storage. In addition, the depth from surface can be transmitted for storage manually to reset counters or ensure the downhole system has maintained a depth log. Other sensors may contribute to determining the interpolation of the depth as it occurs, to maximize depth consistency between surface and downhole. In some embodiments, once a run is complete and memory is being processed or accessed, the depth counters may be compared to the downlinks sent and adjusted to match in case there were losses in transmission. That is, the transmitted depth and depth increments from the surface may be employed to correct or synchronize downhole measurements.

Figure 3:
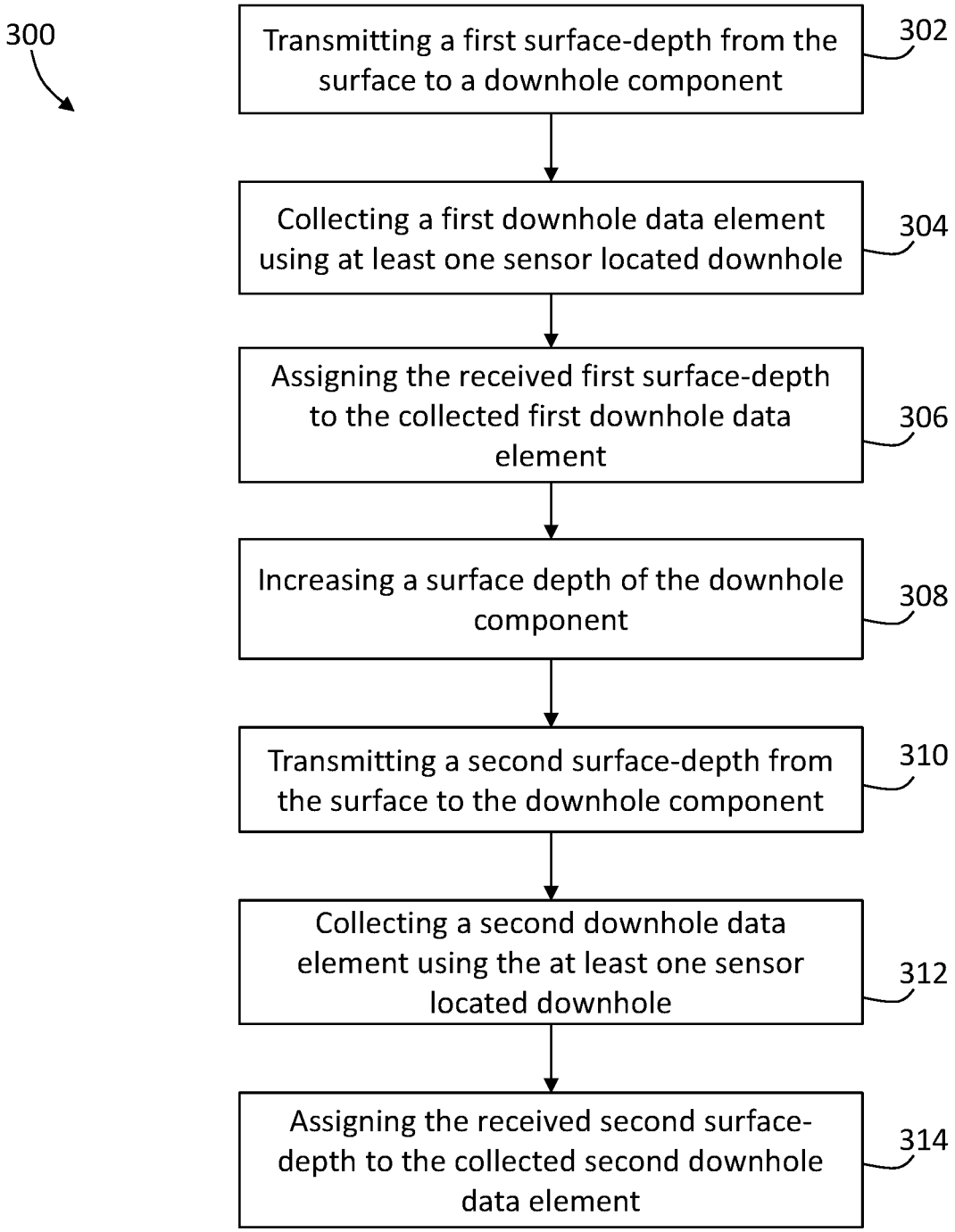
FIG. 3 is a flow process for performing a downhole operation in accordance with an embodiment of the present disclosure.

Turning now to FIG. 3, a schematic flow process 300 for performing a drilling operation, such as a logging-while-drilling operation, is shown. The flow process 200 may be performed using a system similar to that shown and described with respect to FIG. 1, or with other drilling systems as known in the art.

At block 302, a first surface-depth value is transmitted from the surface to a downhole component. The surface-depth value may be obtained using one or more surface-based depth measurements, as described above and/or known in the art. The surface-depth is the distance between a location at the surface and the location of the bit or any other location within the drill string. The surface-depth may be the length of the drill string in the borehole (e.g., measured from a surface location, such as the rotary table or the block). The first surface-depth value may be an initial surface-depth value or may be an incremental depth value, depending on the specific application and use. The transmission from surface to downhole of the initial surface-depth value may be by mud pulse telemetry, downlink, RFID tag sent downhole, rotary speed changes, pump cycling, wired pipe telemetry, electromagnetic transmission, acoustic telemetry, seismic gun firing, vibration along the string, etc.

At block 304, the downhole component will receive the first surface-depth value and can collect a first downhole data element using at least one sensor on or associated with the downhole component. The downhole component may be a BHA, sensor module, steering module, electronics module, etc. as will be appreciated by those of skill in the art. The first downhole data element may be a data point, a data set, an image, or other information that can be collected by one or more downhole sensors or other downhole components (e.g., sampling devices, etc.). The first downhole data element and the received first surface-depth value may be saved into or stored on electronic (e.g., digital) storage media that is part of the downhole component, or an associated electronics component/module.

At block 306, the downhole component (or an associated processor/computing unit) can assign the first surface-depth value to the first downhole data element. As such, the information collected downhole may be assigned with a specific surface-depth value. That is, information or data collected downhole may be synchronized, correlated, or aligned with a surface depth.

At block 308, the surface depth of the downhole component is changed (e.g., increased). In such an instance, the increase in surface depth may be achieved through known operations, such as drilling or other disintegration operations for cutting into or boring into a formation. In some embodiments, if a borehole has already been formed, the change in surface depth may be achieved by lowering (e.g., tripping in), pulling (e.g., tripping out), or forcing the downhole component further into the borehole.

At block 310, a second surface-depth value is transmitted from the surface to the downhole component. The second surface-depth value may be an absolute surface-depth measurement of the downhole component, or may be an incremental surface-depth measurement based on the first surface-depth measurement/value (or some other initial or base-level surface-depth). The transmission of the second surface-depth value may be in the same manner as the transmission of the first surface-depth value.

At block 312, the downhole component will receive the second surface-depth value and can collect a second downhole data element using at least one sensor on or associated with the downhole component.

At block 314, the downhole component (or an associated processor/computing unit) can assign the second surface-depth value to the second downhole data element. As such, the information collected downhole may be assigned with a specific surface-depth value. That is, information or data collected downhole may be synchronized, correlated, or aligned with a surface depth.

Accordingly, the flow process 300 provides for enabling surface-depth data to be associated with measurements or other data collected downhole, thereby improving the accuracy, reliability, and efficiency of downhole data collection and/or processing thereof. In some embodiments, the flow process 300 may be repeated multiple times to obtain a dataset of downhole data elements with associated surface-depth information. The dataset may be used for downhole processing, may be transmitted to the surface with the embedded surface-depth information, or may be saved and retrieved from a downhole component after tripping from the borehole. Various data analysis and/or planning may be performed using the depth-correlated downhole data elements.

Advantageously, embodiments described herein enable improved depth measurement to be provided downhole during a drilling operation. Typically, during logging-while-drilling operations, measurements are taken time based at different depths and transmitted individually uphole where the depth is assigned to the measurements. However, there is currently no possibility of combining measurements downhole for advanced evaluation due to the different depths which such measurements are taken. Advantageously, embodiments described herein provide a downhole depth which can be built up to provide accurate solutions without transmitting each individual measurement (time consuming). Further, embodiments described herein provide simple transmitted values that can provide answers for decision making (e.g., geosteering, production decisions, etc.).

While embodiments described herein have been described with reference to specific figures, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed, but that the present disclosure will include all embodiments falling within the scope of the appended claims or the following description of possible embodiments.

Embodiment 1: A method of performing a downhole operation, the method comprising: determining, at the earth surface, a first depth value of a downhole component in a borehole; transmitting to the downhole component in the borehole a first signal indicating the first depth value; changing a depth of the downhole component in the borehole; determining, at the earth surface, a second depth value of the downhole component in the borehole; transmitting, to the downhole component in the borehole, a second signal indicating the second depth value; and updating a downhole operation performed by the downhole component based on at least one of the first depth value and the second depth value.

Embodiment 2: The method of performing a downhole operation of any preceding embodiment, wherein at least one of the first signal and the second signal is transmitted by one of mud pulse telemetry, rotary speed changes, pump cycling, electromagnetic telemetry, and acoustic telemetry.

Embodiment 3: The method of performing a downhole operation of any preceding embodiment, further comprising collecting a first downhole data element and a second downhole data element using at least one sensor of the downhole component and assigning the first depth value to the first downhole data element and assigning the second depth value to the second downhole data element.

Embodiment 4: The method of performing a downhole operation of any preceding embodiment, further comprising storing the first downhole data element with the assigned first depth value in a memory of the downhole component.

Embodiment 5: The method of performing a downhole operation of any preceding embodiment, wherein the first signal comprises a first predefined code indicating the first depth value is reached and the second signal is a second predefined code indicating the second depth value is reached, wherein the second depth value is an incremental depth value.

Embodiment 6: The method of performing a downhole operation of any preceding embodiment, wherein the first signal comprises the first depth value and the second signal is a predefined code indicating the second depth value is reached, wherein the second depth value is an incremental depth value.

Embodiment 7: The method of performing a downhole operation of any preceding embodiment, wherein the downhole operation is one of a geosteering of a drill string through a subsurface formation and a joined processing of downhole data from different downhole sensors.

Embodiment 8: The method of performing a downhole operation of any preceding embodiment, wherein the second depth value is an incremental depth value, and the downhole operation is collecting and storing downhole data associated with a drilling operation.

Embodiment 9: The method of performing a downhole operation of any preceding embodiment, wherein at least one of the first depth value and the second depth value is obtained using a distance encoder at the surface of the earth.

Embodiment 10: The method of performing a downhole operation of any preceding embodiment, wherein the second depth value is an incremental depth value, and wherein the incremental depth value is a user-defined depth interval.

Embodiment 11: The method of performing a downhole operation of any preceding embodiment, wherein the user-defined depth interval is between 1 foot and 10 feet.

Embodiment 12: A method of collecting downhole data during a downhole operation, the method comprising: transmitting a depth value from the earth surface to a downhole component; collecting a first downhole data element using at least one sensor located on the downhole component; and assigning the depth value to the first downhole data element.

Embodiment 13: The method of collecting downhole data of any preceding embodiment, further comprising transmitting an incremental depth value from the earth surface to the downhole component.

Embodiment 14: The method of collecting downhole data of any preceding embodiment, further comprising collecting a second downhole data element and assigning the incremental depth value to the second downhole data element.

Embodiment 15: The method of collecting downhole data of any preceding embodiment, wherein the first downhole data element is obtained using a first sensor and the second downhole data element is obtained using a second sensor.

Embodiment 16: The method of collecting downhole data of any preceding embodiment, further comprising storing the first downhole data element with the assigned depth value in a memory of the downhole component.

Embodiment 17: The method of collecting downhole data of any preceding embodiment, wherein the transmission of the depth value is by at least one of mud pulse telemetry, an RFID tag sent downhole, rotary speed changes, pump cycling, wired pipe telemetry, electromagnetic transmission, acoustic telemetry, and vibration along a drill string.

Embodiment 18: The method of collecting downhole data of any preceding embodiment, further comprising transmitting from the earth surface a signal indicating an incremental depth value.

Embodiment 19: The method of collecting downhole data of any preceding embodiment, further comprising collecting a second downhole data element, updating the depth value using the incremental depth value and assigning the updated depth value to the second downhole data element.

Embodiment 20: The method of collecting downhole data of any preceding embodiment, further comprising updating a downhole operation performed by the downhole component based on at least one of the depth value and the incremental depth value.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" or "substantially" used in connection with a quantity is inclusive of the stated value and has the meaning dictated by the context (e.g., it includes the degree of error associated with measurement of the particular quantity). For example, the phrase "substantially constant" is inclusive of minor deviations with respect to a fixed value or direction, as will be readily appreciated by those of skill in the art.

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method comprising:

determining, by a distance decoder at an earth surface, a first depth value of a downhole component in a borehole, the downhole component comprising a processor;

transmitting, by a surface control unit, from the earth surface and through a downhole telemetry system to the downhole component in the borehole a first signal indicating the first depth value, determined by the distance decoder;

obtaining, during a drilling operation and using the downhole component, a first image at the first depth value;

changing a depth of the downhole component in the borehole;

determining, by the distance decoder at the earth surface, a second depth value of the downhole component in the borehole;

transmitting, by the surface control unit, from the earth surface and through the downhole telemetry system to the downhole component in the borehole, a second signal indicating the second depth value determined by the distance decoder;

obtaining, during the drilling operation and using the downhole component, a second image at the second depth value;

aligning, during the drilling operation and using the processor in the downhole component, the first image and the second image using the indicated first depth value and the indicated second depth value;

performing in downhole, during the drilling operation, by using the processor in the downhole component, image analysis on the aligned first image and the aligned second image; and updating in the downhole, using the processor in the downhole component, a downhole operation performed by the downhole component based on at least one of the indicated first depth value, the indicated second depth value, and the image analysis of the aligned first image and the aligned second image$_s$ wherein the updating in the downhole of the downhole operation includes transmitting, by the surface control unit, from the earth surface to the downhole component a calibration depth value after changing the depth of the downhole component in the borehole by a predefined depth interval, and calibrating the second depth value using the calibration depth value.

2. The method of claim 1, wherein at least one of the first signal and the second signal is transmitted by mud pulse telemetry.

3. The method of claim 1, wherein the first signal is a first predefined code indicating the first depth value is reached and the second signal is a second predefined code indicating the second depth value is reached, wherein the second depth value is an incremental depth value.

4. The method of claim 1, wherein the first signal comprises the first depth value and the second signal is a predefined code indicating the second depth value is reached, wherein the second depth value is an incremental depth value.

5. The method of claim 1, wherein the downhole operation is one of a geosteering of a drill string through a subsurface formation and a joined processing of downhole data from different downhole sensors.

6. The method of claim 1, wherein the second depth value is an incremental depth value, and wherein the incremental depth value is a user-defined depth interval.

7. The method of claim 6, wherein the user-defined depth interval is between 1 foot and 10 feet.

8. The method of claim 1, wherein the transmitted first signal and the transmitted second signal is a one-bit ping.

9. The method of claim 1, wherein at least one the first signal and the second signal is transmitted by at least one of rotary speed changes, pump cycling, electromagnetic telemetry, and acoustic telemetry.

10. The method of claim 1, wherein the predefined depth interval is 30 m.

11. The method of claim 1, wherein the transmission of the second signal indicating the second depth value is triggered by the surface control unit automatically.

12. The method of claim 1, further comprising transmitting from the downhole component to the surface control unit at least one of the aligned first image and the aligned second image using the processor in the downhole component.

13. A method of collecting downhole data during a downhole operation, the method comprising:

performing a drilling operation in a borehole including a downhole component disposed therein;

determining, by a distance decoder at an earth surface, a first depth value of the downhole component in the borehole;

transmitting, by a surface control unit, from the earth surface and through a downhole telemetry system to the downhole component a first signal indicating the first depth value determined by the distance decoder, the downhole component comprising a processor;

transmitting, by the surface control unit, from the earth surface to the downhole component a calibration depth value after changing a depth of the downhole component in the borehole by a predefined depth interval;

collecting, during the drilling operation, a first downhole data element using at least one sensor located on the downhole component;

assigning, during the drilling operation and using the processor, the indicated first depth value to the first downhole data element;

storing the first downhole data element, the calibration depth value, and the assigned indicated first depth value within a memory of the downhole component; and creating in a downhole and during the drilling operation, using the processor, a downhole log comprising at least the stored first downhole data element and the assigned indicated first depth value.

14. The method of claim 13, further comprising:

determining, using the distance decoder at the earth surface, a second depth value of the downhole component in the borehole;

transmitting, by the surface control unit, from the earth surface and through the downhole telemetry system to the downhole component a second signal indicating the second depth value determined by the distance decoder;

collecting, during the drilling operation, a second downhole data element, using the at least one sensor, and assigning the indicated second depth value to the second downhole data element; and calibrating the second depth value using the calibration depth value.

15. The method of claim 13, further comprising at least one additional downhole data element and an associated assigned depth value to the at least one additional downhole data element, wherein the downhole log is updated in the downhole, using the processor, with the at least one additional downhole data element and the associated assigned depth value.

16. The method of claim 13, wherein the transmission of the first signal is performed by mud pulse telemetry.

17. The method of claim 13, further comprising transmitting from the earth surface a second signal indicating an incremental depth value.

18. The method of claim 17, further comprising:

collecting a second downhole data element, using the at least one sensor;

updating the indicated first depth value using the indicated incremental depth value to provide an updated depth value; and assigning the updated depth value to the second downhole data element.

19. The method of claim 17, further comprising updating in the downhole, using the processor, the downhole operation performed by the downhole component based on at least one of the indicated first depth value and the indicated incremental depth value.

20. The method of claim 13, wherein the transmission of the first signal is performed by at least one of a radio frequency identification (RFID) tag sent in the downhole, rotary speed changes, pump cycling, wired pipe telemetry, electromagnetic transmission, acoustic telemetry, and vibration along a drill string.

* * * * *